United States Patent [19]

McManus

[11] 4,101,183

[45] Jul. 18, 1978

[54] MODULAR OFFICE FURNITURE

[76] Inventor: Francis C. A. McManus, 5301 N. 13th St., Philadelphia, Pa. 19141

[21] Appl. No.: 724,201

[22] Filed: Sep. 17, 1976

[51] Int. Cl.[2] ..... A47B 27/00

[52] U.S. Cl. ..... 312/195; 108/119; 108/124

[58] Field of Search ..... 312/195; 248/188.1; 108/119, 124

[56] References Cited

U.S. PATENT DOCUMENTS

| | | | |
|---|---|---|---|
| 1,831,471 | 11/1931 | Wege | 312/195 |
| 2,482,611 | 9/1949 | Deutemeier | 312/195 |
| 2,675,286 | 4/1954 | Derman | 108/119 |
| 3,103,742 | 9/1963 | Cruson | 248/188.1 |
| 3,108,550 | 10/1963 | Knoblock | 108/124 |
| 3,125,387 | 3/1964 | Abrahamson | 312/195 |
| 3,349,727 | 10/1967 | Hamilton et al. | 108/119 |
| 3,361,088 | 1/1968 | Hodgkin | 108/124 |
| 3,401,653 | 9/1968 | Knoblock | 108/124 |
| 3,561,376 | 2/1971 | Knoblock | 108/124 |

FOREIGN PATENT DOCUMENTS

| | | | |
|---|---|---|---|
| 1,279,355 | 11/1961 | France | 108/119 |
| 361,377 | 5/1962 | Switzerland | 312/195 |

*Primary Examiner*—Paul R. Gilliam
*Assistant Examiner*—Victor N. Sakran
*Attorney, Agent, or Firm*—Caesar, Rivise, Bernstein & Cohen, Ltd.

[57] ABSTRACT

Modular office furniture adapted for rapid and simple assembly and disassembly. The furniture basically comprises a generally planar top module adapted for use as a desk top or table top or the like and a pedestal module for supporting the top module. Quick-acting snap connecting means are provided for securing the top module onto the pedestal module. The snap connecting means includes a cylindrical locking rod and an associated clip having a resilient mouth into which the rod is adapted to be snap fit. The rod is permanently secured to the pedestal and the clip is permanently secured to the top. A pair of guide rings are provided secured to the locking rod and spaced apart thereon by sufficient distance to permit the clip to fit therebetween when the rod is within the clip mouth but to prevent longitudinal relative movement between the rod and clip. The pedestal unit may be of various configurations, e.g., drawer units, and more than one pedestal unit can be utilized with the top module, if desired.

2 Claims, 7 Drawing Figures

MODULAR OFFICE FURNITURE

This invention relates generally to furniture and more particularly to modular furniture adapted for use in offices.

Various types of modular furniture systems have been disclosed in the patent literature and some are commercially available. However, most systems are designed for in-home as opposed to commercial use such as in offices since office applications generally require sturdy utilitarian furniture. Heretofore such sturdy and utilitarian furniture has been achieved by integrally constructed furniture.

The drawback with integrally constructed furniture is that the purchaser is forced to buy items that have only standard features and functions. Therefore, the buyer must be satisfied with the type of product that the manufacturer offers since there is no allowance for personal or professional preferences. In contradistinction, with modular furniture systems a purchaser can customize his office furniture, that is, have exactly the furniture features, e.g., drawers, pull-outs, etc., he desires.

While modularity of office furniture is desired, prior art systems have not achieved such modularity on a viable basis. It is believed that the prior art systems suffer from various drawbacks, such as, complexity, size, cost and appearance of assembled furniture.

Accordingly, it is a general object of this invention to provide modular office furniture which overcomes the disadvantages of the prior art.

It is a further object of this invention to provide modular office furniture including relatively simple means for effecting the rapid and simple assembly and disassembly of the piece of office furniture.

It is still a further object of this invention to provide a modular furniture system wherein the user can customize his furniture to produce exactly the type of furniture and features desired by the mere interchangeability of components in the system.

These and other objects of the instant invention are achieved by providing modular office furniture adapted for rapid and simple assembly and disassembly. The furniture comprises a generally planar top module adapted for use as a table top or a desk surface, a pedestal module for supporting the top module and quick acting snap connecting means for securing the top module onto the pedestal module. The snap connecting means include a first component in the form of a cylindrical locking rod and a second component in the form of at least one clip having a resilient mouth into which the rod is adapted to be snap-fit. One of the components is permanently secured to the top module and the other component is permanently secured to the pedestal module.

Other objects and many of the attendant advantages of the instant invention will be readily appreciated as the same becomes better understood by reference to the following detailed description when considered in connection with the accompanying drawings wherein.

Figure 1:
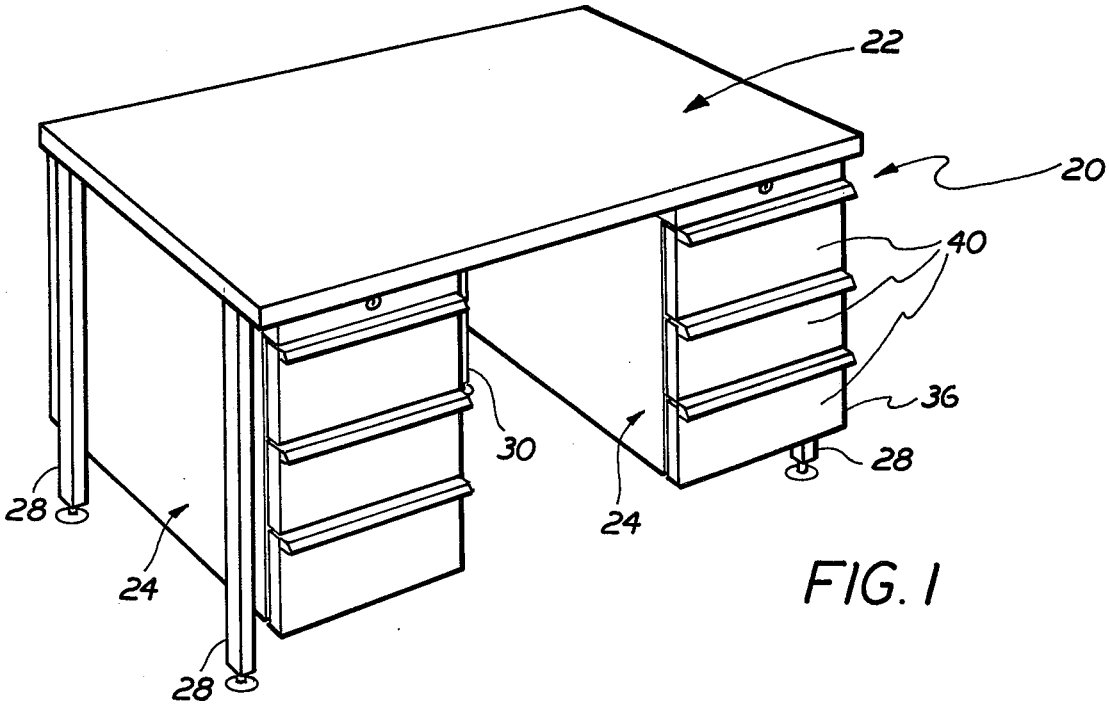
FIG. 1 is a perspective view of one piece of office furniture constructed of the modular furniture system of the instant invention.

Referring now to the various figures of the drawing wherein like reference characters refer to like parts there is shown a piece of office furniture 20 constructed of modular components in accordance with the system of the instant invention. The unit 20 comprises a six-drawered desk. It is to be understood that the desk 20 is only exemplary of one of many types of office furniture which can be constructed of modular components in accordance with the teachings of this invention by mere substitution of component modules thereof.

Desk 20 basically comprises a top module 22, a pair of pedestal modules 24 and snap connecting means 26 for securely mounting the top 22 on the pedestal 24 to complete the piece of furniture 20.

The pedestals 24 are of substantially identical construction, with the only difference being that they are mirror images of one another, that is one pedestal unit has a pair of outside legs 28 on the left side of the pedestal when viewed from the front while the other pedestal unit has its outside legs 28 on the right side of the pedestal. In addition, each pedestal unit includes a third leg 30 mounted on the inside surface of the pedestal unit.

In view of the similarity of the pedestal units 24 only the unit shown in the left side of the desk of FIG. 1 will be described in detail hereinafter.

Figure 2:
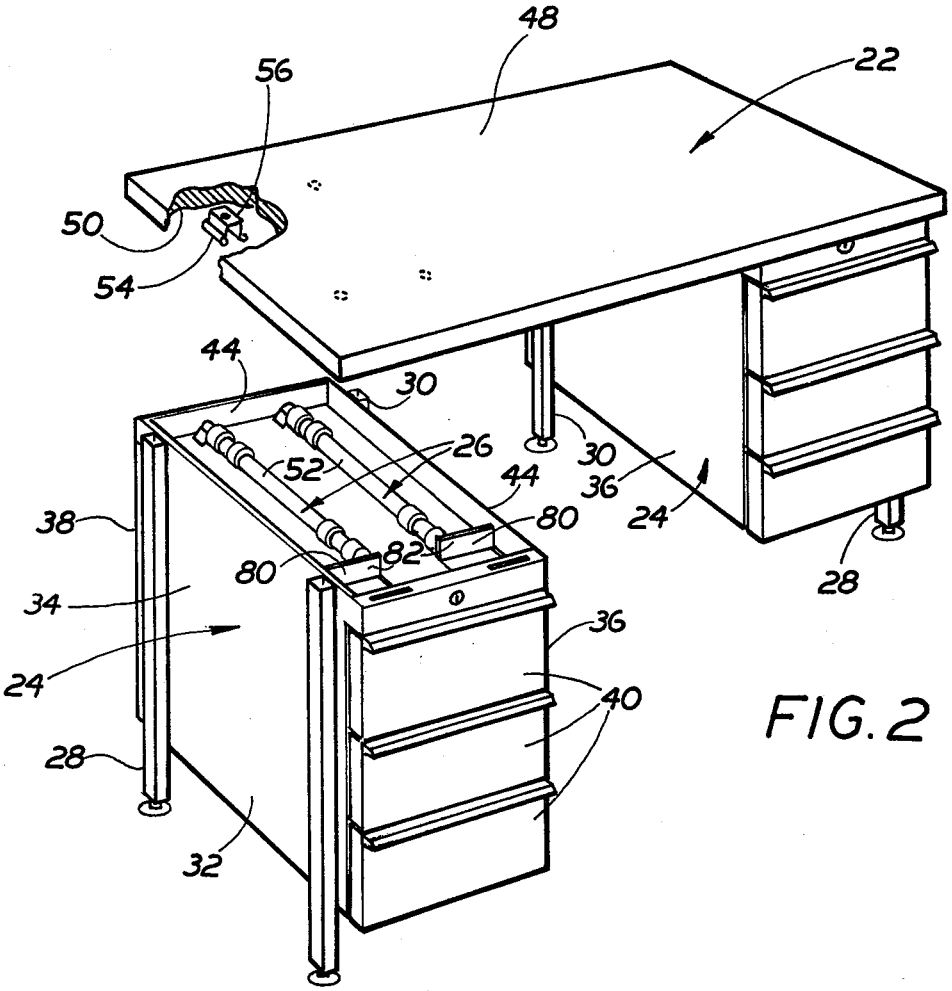
FIG. 2 is an exploded view, partially in section of the furniture shown in FIG. 1.

As can be seen in FIGS. 1 and 2, pedestal 24 comprises a pedestal shell 32 having an outside wall 34, an inside wall 36 and a back wall 38. The front of the pedestal is open and is adapted to support therein, via slides, not shown, a plurality of drawers 40, three of which are shown in the embodiment of FIGS. 1 and 2. It should be pointed out at this juncture that the pedestal 24 can be constructed to accomodate more or less drawers than shown in FIGS. 1 and 2 as well as other functional components, such as dictation slides, etc., to provide additional work surfaces, typewriter stations or supports, etc.

Figure 4:
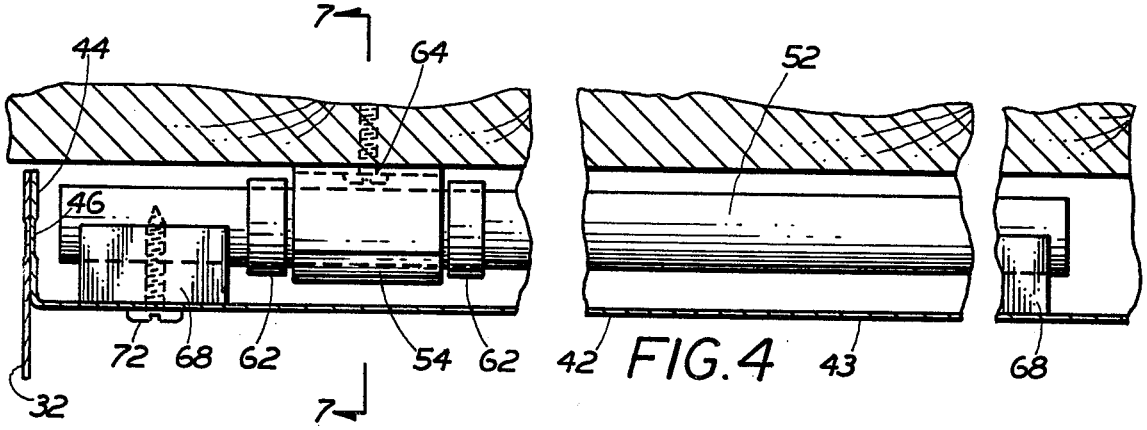
FIG. 4 is a sectional view taken along line 4—4 of FIG. 3.
Figure 5:
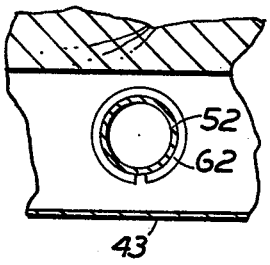
FIG. 5 is a sectional view taken along line 5—5 of FIG. 3.

The top of the pedestal 24 is closed and covered by a pedestal top 42. Top 42 is a tray-like member having a bottom wall 43 which is rectangular in shape and coextensive in size with the top of the pedestal 24 and which includes upstanding flanges 44 extending about the periphery thereof. As can be seen in FIG. 4, the pedestal top 42 is connected to the pedestal via a weld joint 46 at the interface of flanges 44 and the side wall, e.g., 38, of the pedestal shell 32.

The legs 28 and 30 are each formed of elongated tubular members, such as rectangular chromium tubes, and are secured to the side walls 34 and 36 of the pedestal 24 via any type of conventional connection means, such as bolts, weld joints, etc.

As can be seen in FIGS. 1 and 2, top 22 is a generally rectangular shaped member having a planar top surface 48 and a bottom surface 50. The size and shape of top 22 is merely exemplary. It is to be understood that top 22 can be of any shape and can be of various sizes, depending upon the type and size of the office furniture unit to be constructed. For example, if desk 20 were desired to be a conference desk the top 22 would be much larger than that shown in FIGS. 1 and 2. The large conference desk top would be connected to the pedestals in the same manner as the top 22 shown in FIG. 1 and which will be described hereinafter.

In accordance with a preferred aspect of this invention quick-acting, snap fastening means 26 are provided to effect the securement of the top module 22 onto the pedestal modules 24.

Figure 6:
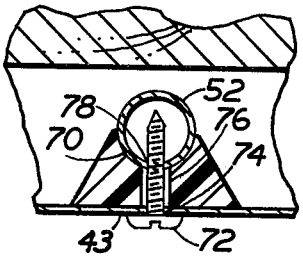
FIG. 6 is a sectional view taken along line 6—6 of FIG. 3.
Figure 7:
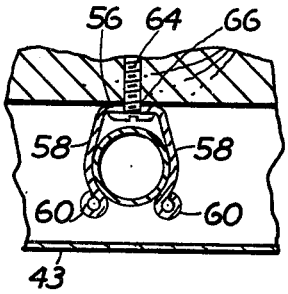
FIG. 7 is a sectional view taken along line 7—7 of FIG. 4.

The snap fitting connecting means 26 basically comprises two components, namely, a locking rod 52 (see FIGS. 2–6) and a clip 54 (see FIGS. 2, 4 and 7).

As can be seen in FIGS. 2 and 7, clip 54 includes a base portion from which a pair of side flanges or arms 58 project. The free end of each arm 58 terminates in a rounded edge 60. The clip 54 is preferably formed of a resilient and strong material, such as spring steel. The arms 58 are spaced from one another by a distance slightly less than the outside diameter of the rod 52 so that when the rod is disposed therebetween it is snugly held in place. The mouth of the clip, that is the space between free ends 60 is substantially smaller than the outside diameter of the rod 52 so as to prevent the rod from coming out from between the arms 58 once it is in place, yet is sufficiently large to enable the rod to be passed therethrough for disposition between the arms without difficulty.

The rod 52 is an elongated tubular member having a circular outer periphery. The locking rod is preferably dimensioned such that it extends for a substantial length along the pedestal top.

Figure 3:
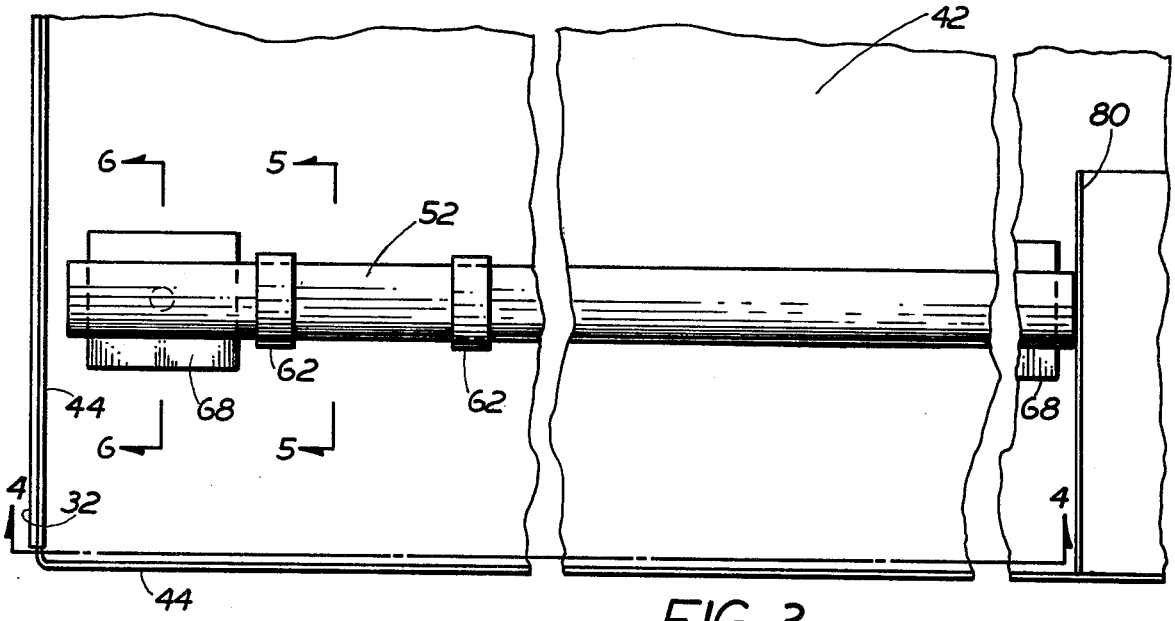
FIG. 3 is an enlarged top view of a portion of the components shown in FIG. 2.

As can be seen in FIGS. 2 and 3, each locking rod includes two pair of spacer rings 62 disposed thereabout. Each spacer ring is of a resilient split-ring configuration and adapted to be frictionally held on the outer periphery of the rod. The rings 62 of each pair are spaced from one another by a distance sufficient to permit the clip 54 to be disposed therebetween. The rings are tightly engaged about the periphery of the rod and cannot move longitudinally with respect thereto. The function of the rings is to position the clip with respect to the rod to preclude longitudinal movement between the clip and the rod.

In accordance with the embodiment of the invention shown in FIGS. 2–7 the clip 54 is mounted on and permanently secured to the underside 50 of planar top module 22 and the rod is mounted and permanently secured to the pedestal top 42. It should be pointed out at this juncture that such an arrangement is merely exemplary and it is contemplated within the scope of this invention that the locking bar be permanently secured and mounted onto the module top 22 and the clip permanently secured and mounted onto the pedestal module.

The mounting of the clip onto the top module 22 is accomplished via a threaded fastening member, such as screw 64. To that end, screw 64 extends through an opening 66 in the clip bottom 56 and into the body of the top 22. The locking rod 52 is mounted on the pedestal top and spaced slightly above the bottom surface thereof via a pair of rod supports 68 (FIGS. 4 and 6). As can be seen therein, each support member 68 is a generally triangular shaped member having a concave recess 70 extending longitudinally therealong at the top edge. The recess 70 is adapted to snuggly receive a substantial portion of the periphery of locking rod 52. The rod 52 is held in place onto the support 68 via a threaded fastening member or screw 72. To that end, screw 72 extends through an opening 74 in the pedestal top 42, through an aligned opening 76 extending through support 68 and through an opening 78 in the wall of the locking rod 52.

In accordance with a preferred embodiment of this invention each locking rod is mounted on the pedestal top via a pair of supports 68, one disposed adjacent to each end of the rod. A flanged stop 80 (FIG. 2) is mounted on the pedestal top 42 with an upstanding portion 82 thereof disposed immediately adjacent to one end of the locking rod 52. The member 80 serves to longitudinally position the locking rod in place on the pedestal top.

As should be appreciated from the foregoing, assembly of the desk shown in FIG. 1 can be accomplished relatively quickly and easily by merely snapping the clips 54 mounted on the underside of the top module 22 into the respective spaces on the locking bars mounted on the pedestal module 24 to thereby secure the top 22 onto the pedestals 24. No special tools or techniques are needed and the assembly can be carried out within a few minutes.

If it is desired to change a configuration of the desk such as by the replacement of one of the pedestal units with another unit all that needs to be done is the disconnection of the clip from the locking bars of the pedestal unit to be replaced and the subsequent connection of the clip onto the locking bar of the replacement component.

It should be pointed out at this juncture that the modular office furniture of the instant invention also includes various features existing in conventional furniture such as the use of drawer stoppers to ensure that the drawers remain within the pedestal when in operation, suspension rods for providing proper positioning of drawers, lock rods to provide security for articles contained within the drawers, suspension tracks for file drawers to provide drawer stability, modesty panels for providing internal concealment, etc.

It should also be pointed out that while a desk shown is constructed in accordance with the teachings of the instant invention it is to be understood that various other types of office furniture can also be so constructed. For example, use of a center pedestal module in addition to the pedestal modules 24 shown herein enables the assembly of a credenza.

It should be appreciated from the above disclosure that the system of the instant invention offers wide flexibility in the assembly of office furniture. Since universal components or modules are used for more than one piece of furniture substantial savings can be achieved when changing one furniture type to another. For example, when there is a desire to change from a standard desk to a conference desk, all that is required is to purchase a conference desk top. The existing desk top can be removed and the new desk top connected onto the pedestals. This eliminates the need to buy a new desk, which would have to be done when using conventional office furniture. Also, the replaced desk top can be used for a table by the acquisition of a table frame constructed in accordance with the teachings of this invention. Another feature of the instant invention is that if a particular piece of furniture is damaged, all that needs to be done is to replace the damaged module with a new module, thereby obviating the purchase of an entirely new piece of furniture. Further still, the modular system of the instant invention enables improvements or other changes to be made to the appearance and/or function of the furniture simply by adding to, or removing modular parts of the piece of furniture. For example, a standard type desk can be readily converted to a secretarial desk, or vice versa. Needless to say this is of extreme commercial importance since it obviates the need for the purchase of new furniture.

Without further elaboration, the foregoing will so fully illustrate my invention that others may, by applying current or future knowledge, readily adapt the same for use under various conditions of service.

What is claimed as the invention is:

1. Modular office furniture adapted for rapid and simple assembly and disassembly comprising a generally planar top module adapted for use as a table top and a desk surface, a pedestal module comprising a pedestal shell and a pedestal top for supporting said top module and quick-acting snap connecting means for securing said top module onto said pedestal module, said snap connecting means including a first component in the form of a pair of cylindrical locking rods and a second component in the form of at least two clips, each having a resilient mouth into which an associated rod is adapted to be snap-fit, said snap connecting means also comprising a respective pair of guide rings secured to each of said locking rods and spaced apart by the length of said clip to permit said clip to fit therebetween when said rod is within said clip mouth to prevent longitudinal relative movement between said rod and clip, one of said components being permanently secured to said top module and the other component being permanently secured to said pedestal module, with the module to which said locking rods are secured having two pairs of support members permanently secured thereto, each of said support members including a recess in which an end portion of a respective rod is disposed and permanently secured to fastening means, said support members serving to hold said rods parallel to but away from said module to facilitate the securement of said clips to said rods, said pedestal top including a flanged stop abutting an end of each of said rods to longitudinally position said rods with respect to said support members.

2. The furniture of claim 1 wherein said locking rods are permanently secured to said pedestal module and said clips are permanently secured to said top module.

* * * * *